US006071020A

United States Patent [19]

Verlinden et al.

[11] Patent Number: 6,071,020

[45] Date of Patent: Jun. 6, 2000

[54] APPARATUS FOR THE PROCESSING OF PHOTOGRAPHIC SHEET MATERIAL

[75] Inventors: Bartholomeus Verlinden, Tongeren; Patrick Van den Bergen, Hove, both of Belgium

[73] Assignee: Agfa-Gevaert, Mortsel, Belgium

[21] Appl. No.: 09/142,008

[22] PCT Filed: Feb. 25, 1997

[86] PCT No.: PCT/EP97/00912

§ 371 Date: Aug. 28, 1998

§ 102(e) Date: Aug. 28, 1998

[87] PCT Pub. No.: WO97/33196

PCT Pub. Date: Sep. 12, 1997

[30] Foreign Application Priority Data

Mar. 7, 1996 [EP] European Pat. Off. ..... 96200629

[51] Int. Cl.[7] ..... G03D 3/02; G03D 3/08

[52] U.S. Cl. ..... 396/612; 396/626; 396/636

[58] Field of Search ..... 396/612, 617, 396/622, 626, 636, 641

[56] References Cited

U.S. PATENT DOCUMENTS

| | | | |
|---|---|---|---|
| 1,890,026 | 12/1932 | Barkelew | 134/122 R |
| 5,108,878 | 4/1992 | Nakamura | 430/626 |
| 5,528,329 | 6/1996 | Sawada et al. | 396/622 |

*Primary Examiner*—D. Rutledge
*Attorney, Agent, or Firm*—Baker Botts L.L.P.

[57] ABSTRACT

An apparatus, having relatively low capital cost, for the processing of photographic sheet material (22) comprises a plurality of closed treatment cells (12$^1$, 12$^2$, 12$^3$, 12$^4$) and a sheet material path (20) extending through the cells in sequence. A following cell (12$^3$) has a treatment liquid inlet (40) and a treatment liquid outlet (42). The treatment liquid outlet (42) is connected to a treatment liquid inlet (44) of a preceding cell (12$^2$) by way of a connecting passage (46). A single pump (48) is sufficient to transfer treatment liquid through the cells.

10 Claims, 1 Drawing Sheet

APPARATUS FOR THE PROCESSING OF PHOTOGRAPHIC SHEET MATERIAL

FIELD OF THE INVENTION

This invention relates to an apparatus for the processing of photographic sheet material, such as X-ray film, presensitised plates, graphic art film and paper, and offset plates. In particular the invention relates to such an apparatus comprising a plurality of closed treatment cells and means defining a sheet material path through the cells in sequence, and to a method of processing photographic sheet material in such an apparatus.

BACKGROUND OF INVENTION

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. U.S. Pat. No. 4,166,689 (Schausberger et al. assigned to Agfa-Gevaert AG) describes such an apparatus.

It is known in the art to perform the rinsing of a silver halide photographic material which has been developed and fixed, by means of a "cascades" rinsing station which comprises two or more rinsing tanks through which the material is passed in succession, the rinsing liquid flowing in counter-current. The advantage is that the last rinsing tank will contain almost fresh rinsing water so that silver effluent will be small. Cascade processing of sheet materials with other processing liquids, such as developers or fixers, also has advantages.

Such a cascade rinsing arrangement is known in which a pump is provided for feeding liquid to the last cell and further pumps are provided for transferring liquid from each cell to its preceding cell. The provision of a pump between each pair of adjacent cells is costly, especially bearing in mind that such pumps represent a significant proportion of the cost of the total apparatus.

While the use of pumps in a horizontal processing apparatus can be avoided by an overflow cascade, liquid levels would be different in different cells and difficult to control in view of surface effects.

OBJECTS OF INVENTION

It is an objective of the present invention to provide an apparatus for the processing of photographic sheet material where the number of pumps used in the apparatus can be significantly reduced while maintaining the advantages of cascade processing.

SUMMARY OF THE INVENTION

We have discovered that this and other useful objects can be realised by the use of closed cells in addition to the provision of a connecting passage leading from a following cell to a preceding cell.

According to a first aspect of the invention there is provided an apparatus for the processing of photographic sheet material comprising a plurality of treatment cells and means defining a sheet material path through the cells in sequence, characterised in that a following one of the cells has a treatment liquid inlet and a treatment liquid outlet, the treatment liquid outlet being connected to a treatment liquid inlet of a preceding one of the cells by way of a connecting passage and in that at least the following cell is a closed cell.

In another aspect, the invention provides a method of processing of photographic sheet material comprising passing the sheet material along a sheet material path in sequence through a plurality of treatment cells, characterised by feeding treatment liquid to a treatment liquid inlet of a closed following one of the cells and passing the treatment liquid from a treatment liquid outlet of the closed following cell to a treatment liquid inlet of a preceding one of the cells by way of a connecting passage.

The following treatment cell, and preferably all the treatment cells in the cascade, are closed. Not only does this feature reduce evaporation, oxidation and carbonisation of the treatment liquid, it also enables the number of pumps and sensors which need to be used with the apparatus to be significantly reduced. In an embodiment of the invention, a treatment liquid pump is connected to the inlet of the following cell to cause flow of treatment liquid in sequence through the following cell, through the connecting passage and through the preceding cell. Thus the need for a pump between each cell is avoided, since provided that the cells are closed, one pump for each treatment liquid is sufficient to ensure flow through all the cells.

The apparatus according to the invention may further comprise means to ensure the filling of at least the preceding cell with treatment liquid to a predetermined level, such as a liquid level sensor associated with at least the preceding cell. Only one such sensor is required, since the preceding cell is filled with treatment liquid after the following cell has been filled. The predetermined level of treatment liquid in the following cell may be defined, for example, by the position of the treatment liquid outlet. Where any cell is not a closed cell, it would be preferable to provide a liquid level sensor in each cell, so as to enable proper compensation for the loss of liquid therefrom by evaporation. For this reason we prefer that all cells in the apparatus be closed.

The preceding cell will usually be that cell which immediately precedes the following cell, although it is possible to provide one or more further cells between the following cell and the preceding cell if desired.

The connecting passage may be formed within a wall of the housing of the apparatus or may be constituted by additional pipework. Preferably, the passage, at least along part of its length, is narrow enough to limit the reverse flow of treatment liquid from the preceding cell to the following cell when the pump is not operating. However, the passage should not be so narrow as to significantly restrict the flow of treatment liquid in the operational direction when the pump is operating. A one-way valve may be provided in the connecting passage to further limit the reverse flow of treatment liquid when the pump is not operating.

Each cell preferably comprises a housing within which is mounted a rotatable roller biased towards a reaction surface to define a roller nip there-between through which the sheet material path extends. In such an arrangement, each cell may further comprise associated sealing means serving to provide a gas- and liquid-tight seal between the roller and reaction surface on the one hand and the housing on the other. The treatment liquid outlet of the following cell is preferably so located as to ensure that the roller and the reaction surface are wetted by treatment liquid in the following cell. This provides the advantage that the maximum film path length is used for processing, and the deposition of salts on the roller and reaction surface during stand-by is reduced. Arranging for the roller and the reaction surface to be constantly wetted by the treatment liquid is preferred when the treatment liquids in adjacent cells are identical or compatible.

In one possible arrangement for the apparatus, the cells are mounted one above the other in a stack to define a substantially vertical sheet material path through the apparatus. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus. In a vertical apparatus, the following cell may be above or below the preceding cell, depending on the direction of the sheet material transport path.

In an alternative configuration, the cells are mounted one beside the other to define a substantially horizontal sheet material path through the apparatus.

The invention is applicable to any treatment liquid, in particular treatment liquids selected from photographic sheet material developer, photographic sheet material fixer, and wash water. The apparatus and method described herein can be used to process a number of different types of photographic sheet material, including for example X-ray film, one- and two-sheet DTR sheet materials, lithographic plates and graphic arts sheet materials, the details of the apparatus being modified as desired according to the intended use.

DETAILED DESCRIPTION OF THE INVENTION

Figure 1:
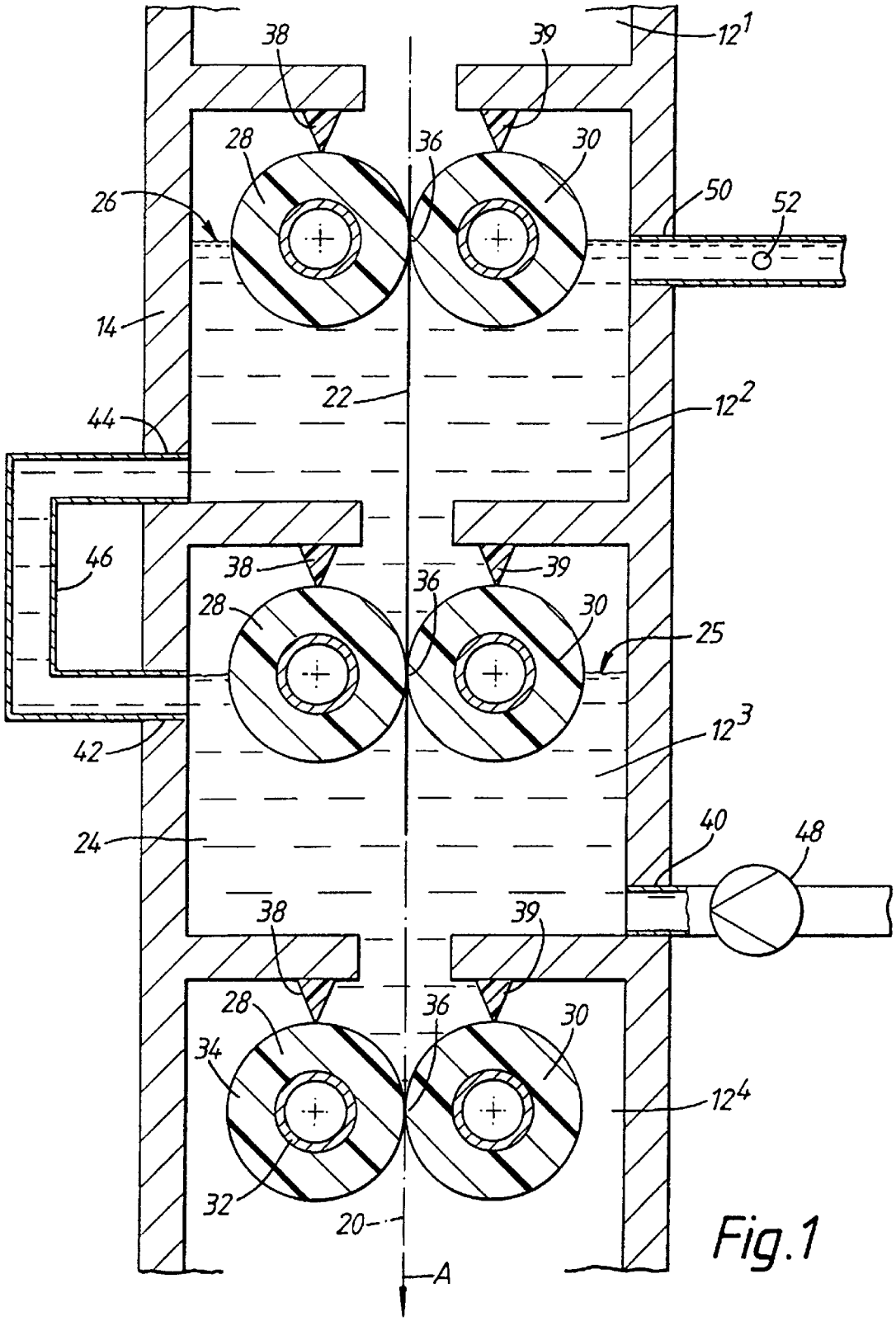

The invention will be described by the following illustrative embodiments with reference to the accompanying drawing without the intention to limit the invention thereto, and in which:

FIG. 1 is a cross-sectional view of two cells of a vertical processing apparatus according to the invention, with adjacent cells being partly shown.

As shown in FIG. 1, an apparatus for the processing of photographic sheet material comprising a number of closed treatment cells $\mathbf{12}^1$, $\mathbf{12}^2$, $\mathbf{12}^3$, $\mathbf{12}^4$. The cells are mounted one above the other in the stack to define the substantially vertical sheet material path 20 through the cells in sequence, the sheet material 22 moving in a downwards direction as indicated by the arrow A. The cells may be of a modular structure or may be part of an integral apparatus as shown. The treatment cells $\mathbf{12}^1$, $\mathbf{12}^2$, $\mathbf{12}^3$, $\mathbf{12}^4$ are closed.

Only part of the apparatus is shown in FIG. 1. The cell $\mathbf{12}^1$ which is only partly shown is for example a developing cell. Cells $\mathbf{12}^2$ and $\mathbf{12}^3$ represent a cascade of fixing cells in which the developed sheet material is fixed. The cascade as shown consists of only two cells but further cells could be added as desired. The first fixing cell $\mathbf{12}^2$ is referred to herein as the preceding cell, the second fixing cell $\mathbf{12}^3$ as the following cell. Cell $\mathbf{12}^4$ which again is only partly shown, represents a washing cell, or the first of a cascade of washing cells. The liquid in the washing cell $\mathbf{12}^4$ is preferably not in contact with the rollers of that cell.

Each cell comprises a housing 14 within which is mounted a first rotatable roller 28 biased towards the reaction surface in the form of a second rotatable roller 30 to define the roller nip 36 there-between through which the sheet material path 20 extends. Each roller 28, 30 is of the squeegee type comprising a stainless steel hollow core 32 carrying an elastomeric covering 34. The core 32 is in cylindrical form having constant internal and external diameters along the length thereof. The rollers 28, 30 are biased towards each other with a force sufficient to effect a liquid tight seal but without causing damage to the photographic sheet material 22 as it passes there-between. The line of contact between the roller surfaces 29 and 31 defines the nip 36. The sheet material preferably has a width which is at least 10 mm smaller than the length of the nip, so as to enable a spacing of at least 5 mm between the edges of the sheet and the adjacent limit of the nip 36, thereby to minimise leakage. The rollers 28, 30 are coupled to drive means (not shown) so as to constitute drive rollers for driving the sheet material 22 along the sheet material path 20.

Each cell further comprises associated sealing members diagrammatically indicated at 38 and 39, the sealing members being secured to the housing 14 and serving to provide the gas- and liquid-tight seal between the rollers 28, 30 on the one hand and the housing 14 on the other. The treatment liquid 24 is therefore retained in each cell by the rollers 28, 30 and the sealing members 38, 39. Thus, treatment liquid from cell $\mathbf{12}^2$ is prevented from falling into the lower cell $\mathbf{12}^3$ by the rollers 28, 30 and sealing members 38, 39, while vapours from the lower cell $\mathbf{12}^3$ are prevented from entering the cell $\mathbf{12}^2$ or escaping into the environment. This construction has the advantage that the treatment liquid in any one cell is not contaminated by contents of the adjacent cells and that by virtue of the treatment liquids being in a closed system evaporation, oxidation and carbonisation thereof is significantly reduced (and any other undesirable exchange between the treatment liquid and the environment).

The following cell $\mathbf{12}^3$ has a treatment liquid inlet 40 and a treatment liquid outlet 42, the treatment liquid outlet 42 being connected to a treatment liquid inlet 44 of the immediately preceding cell $\mathbf{12}^2$ by way of a connecting passage 46. The connecting passage 46 is constituted by additional pipework.

A treatment liquid pump 48 is connected to the inlet 40 of the following cell $\mathbf{12}^3$ to cause flow of treatment liquid 24 in sequence through the following cell $\mathbf{12}^3$, through the connecting passage 46 and through the preceding cell $\mathbf{12}^2$. The passage 46 is narrow enough to limit the reverse diffusion from the preceding cell $\mathbf{12}^2$ to the following cell $\mathbf{12}^3$ when the pump 48 is not operating. However, the passage 46 is not so narrow as to significantly restrict the flow of treatment liquid 24 in the operational direction when the pump 48 is operating. As shown, the treatment liquid inlet 44 of the preceding cell $12^2$, is below the level 26 of treatment liquid therein. It is also possible to place the inlet 44 above the level 26, such an arrangement leading to the advantage that reverse diffusion is prevented.

The treatment liquid outlet 42 of the following cell $12^3$ is located as to ensure that the rollers 28, 30 are wetted by treatment liquid 24 in the following cell $12^3$.

The preceding cell $12^2$ also has a treatment liquid outlet 50. A liquid level sensor 52, connected to the outlet 50 of the preceding cell $12^2$ ensures the filling of the preceding cell $12^2$ and the following cell $12^3$ with treatment liquid 24 to predetermined levels.

The predetermined level 25 of treatment liquid 24 in the following cell $12^3$ is defined by the position of the treatment liquid outlet 42. The predetermined level 26 of treatment liquid 24 in the preceding cell $12^2$ is defined by the position of the treatment liquid outlet 50.

In use photographic sheet material 22 is passed along the sheet material path 20 in sequence through the closed treatment cells $12^1$, $12^2$, $12^3$, $12^4$. Treatment liquid 24, in this case a fixing solution, is fed to the treatment liquid inlet 40 of the following cell $12^3$. The treatment liquid 24 is passed, under force of the pump 48, from the treatment liquid outlet 42 of the following cell $12^3$ to the treatment liquid inlet 44 of the preceding cell $12^2$ by way of the connecting passage 46.

In a modification, the rollers 28, 30 may be mounted in such a manner as to be capable of being moved away from each other. Such a modified apparatus may be cleaned periodically by using the pump 48 to pump a cleaning liquid, such as water, into the cells and then moving the rollers of each pair 28, 30 away from each other to allow the cleaning liquid to drain from the apparatus, or from selected cells thereof.

In an alternative configuration, the cells are mounted one beside the other to define the substantially horizontal sheet material path through the apparatus.

What is claimed is:

1. An apparatus for the processing of photographic sheet material (22) comprising a plurality of treatment cells ($12^1$, $12^2$, $12^3$, $12^4$) defining a sheet material path (20) through said cells in sequence, wherein a following one of said cells ($12^3$), has a treatment liquid inlet (40) and a treatment liquid outlet (42), said treatment liquid outlet (42) being connected to a treatment liquid inlet (44) of a preceding one of said cells ($12^2$) by way of passage (46), characterized in that at least the following cell ($12^3$) is a closed cell and in that means are provided to ensure the filling of at least said preceding cell ($12^2$) with treatment liquid (24) to a predetermined level (26), said means comprising a liquid level sensor (52) associated with at least said preceding cell ($12^2$).

2. An apparatus according to claim 1, wherein a treatment liquid pump (48) is connected to the inlet (40) of said following cell ($12^3$) to cause flow of treatment liquid (24) in sequence through following cell ($12^3$), through said connecting passage (46) and said preceding cell ($12^2$).

3. An apparatus according to claim 1, wherein said preceding cell ($12^2$) immediately precedes said following cell ($12^3$).

4. An apparatus according to claim 1, wherein each cell comprises a housing (14) within which is mounted a rotatable roller (28) biased towards a reaction surface (30) to define a roller nip (36) there-between through which said sheet material path (20) extends.

5. An apparatus according to claim 4, wherein each cell further comprises associated sealing means (38, 39) serving to provide a gas- and light-tight seal between said roller (28) and said reaction surface (30) on the one hand and said housing (14) on the other.

6. An apparatus according to claim 1, wherein said cells ($12^1$, $12^2$,$2^4$) are mounted one above the other in a stack to define a substantially vertical sheet material path (20) through the apparatus.

7. An apparatus according to claim 5, wherein said treatment liquid outlet (42) of said following cell ($12^3$) is so located as to ensure that said roller (28) and said reaction surface (30) are wetted by treatment liquid (24) in said following cell ($12^3$).

8. An apparatus according to claim 1, wherein said cells ($12^1$, $12^2$,) are mounted one beside the other to define a substantially horizontal sheet material path (20) through the apparatus.

9. A method of processing photographic sheet material comprising passing said sheet material (22) along a sheet material path (20) in sequence through a plurality of treatment cells ($12^1$, $12^2$, $12^3$ $12^4$), feeding treatment liquid (24) to a treatment liquid inlet (40) of a closed following one of said cells ($12^3$) and passing said liquid (24) from a treatment liquid outlet (42) of said closed following cell ($12^3$) to a treatment liquid inlet (44) of a preceding one of said cells ($12^2$) by way of a connecting passage (46), characterized by ensuring the filling of at least said preceding cell ($12^2$) with treatment liquid (24) to a predetermined level (26), by using a liquid level sensor (52) associated with at least said preceding cell ($12^2$).

10. A method according to claim 9, wherein said treatment liquid (24) is selected from photographic sheet material developer, photographic sheet material fixer, and wash water.

* * * * *

UNITED STATES PATENT AND TRADEMARK OFFICE

CERTIFICATE OF CORRECTION

PATENT NO. : 6,071,020

DATED : June 6, 2000

INVENTOR(S) : Verlinden et al.

It is certified that error appears in the above-identified patent and that said Letters Patent is hereby corrected as shown below:

Column 6, line 22: "$(\mathbf{12}^1, \mathbf{12}^2, \mathbf{2}^4)$" should read -- $(\mathbf{12}^1, \mathbf{12}^2, \mathbf{12}^3, \mathbf{12}^4)$ --;

Column 6, line 31: "$(\mathbf{12}^1, \mathbf{12}^2,)$" should read -- $(\mathbf{12}^1, \mathbf{12}^2, \mathbf{12}^3, \mathbf{12}^4)$ --.

Signed and Sealed this

Eighth Day of May, 2001

*Attest:*

Nicholas P. Godici

NICHOLAS P. GODICI

*Attesting Officer*

*Acting Director of the United States Patent and Trademark Office*